US005597151A

United States Patent [19]

Duncan

[11] Patent Number: 5,597,151

[45] Date of Patent: Jan. 28, 1997

[54] STAKE PULLER WITH STAKE SUPPORTING BACK PLATE

[76] Inventor: Charles W. Duncan, 1308 Cole, Denison, Tex. 75020

[21] Appl. No.: 276,035

[22] Filed: Jul. 15, 1994

[51] Int. Cl.[6] ..... B25B 25/00

[52] U.S. Cl. ..... 254/199; 254/131

[58] Field of Search ..... 254/199, 131, 254/120, 132; 204/92

[56] References Cited

U.S. PATENT DOCUMENTS

| | | | |
|---|---|---|---|
| 650,265 | 5/1900 | McChesney | 254/132 |
| 1,761,675 | 6/1930 | Mick | 254/132 |
| 1,848,426 | 3/1932 | Kvall | 254/131 |
| 1,983,749 | 12/1934 | Garrick | 254/30 |
| 2,777,726 | 1/1957 | Lundgren et al. | 294/92 |
| 2,994,510 | 8/1961 | Michalak | 254/30 |
| 4,161,310 | 7/1979 | Parker | 254/30 |
| 5,022,632 | 6/1991 | Beideck | 254/30 |
| 5,100,104 | 3/1992 | Wagner | 254/30 |

FOREIGN PATENT DOCUMENTS

| | | | |
|---|---|---|---|
| 174883 | 2/1917 | Canada | 254/131 |
| 002006440 | 1/1994 | U.S.S.R. | 294/92 |

*Primary Examiner*—Daniel P. Stodola
*Assistant Examiner*—Emmanuel M. Marcelo
*Attorney, Agent, or Firm*—Harris, Tucker & Hardin, P.C.

[57] ABSTRACT

A stake puller (10) for use in removing a stake (4) lodged in the ground (2) utilizes a lever (12) and fulcrum (20) for mechanical advantage. The stake (4) is positioned between a blade means (30) fixed to the end of the lever and a back plate (40) pivotally attached to the blade means. When the user pivots the lever down, the stake is pinched between the forward edge (34) of the blade means (30) and the primary surface (42) of the back plate (40). The primary surface (42) is curved and diverges from the stake. This minimizes any bending or friction forces applied to the stake.

18 Claims, 1 Drawing Sheet

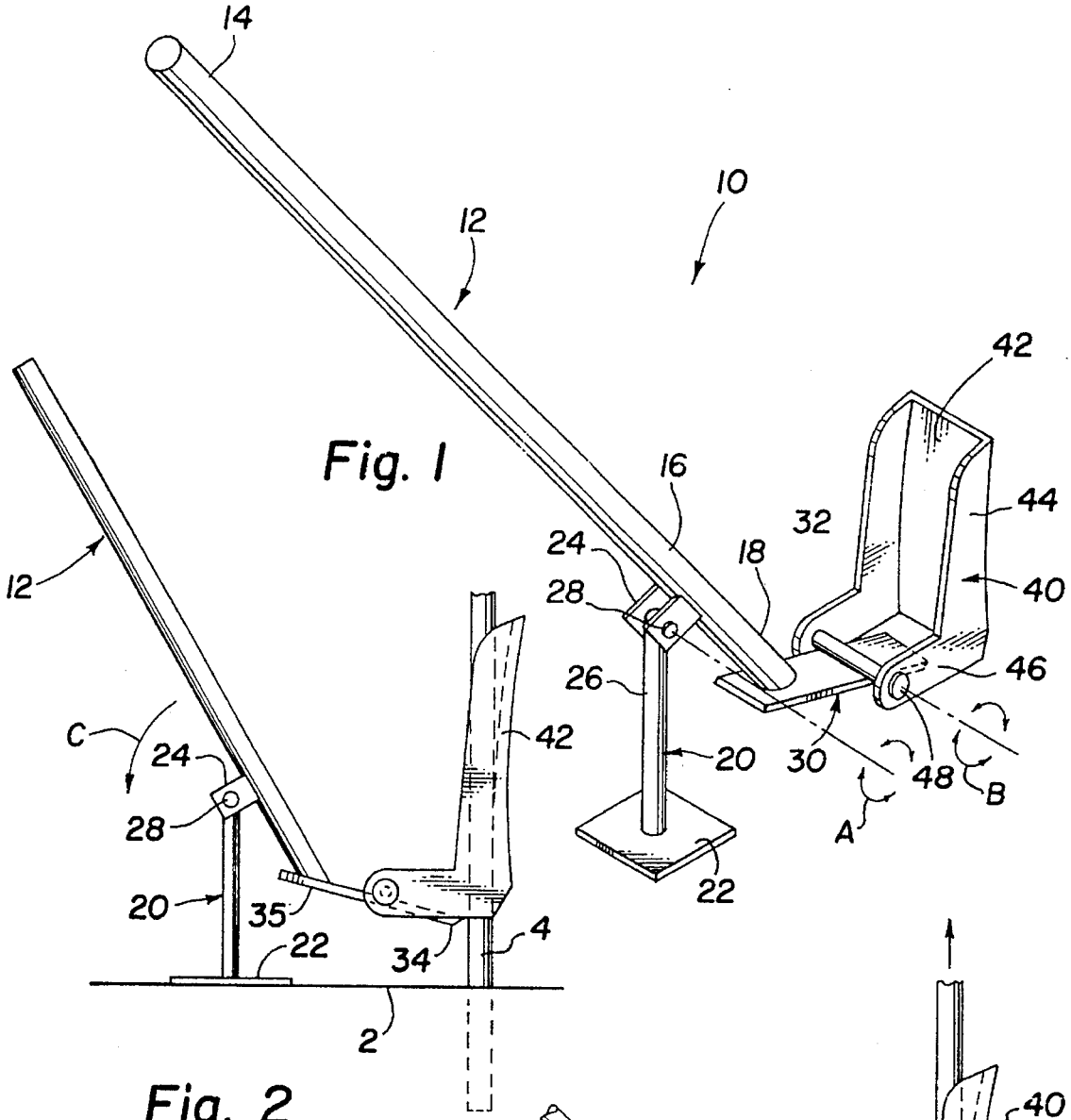
Fig. 1
Fig. 2
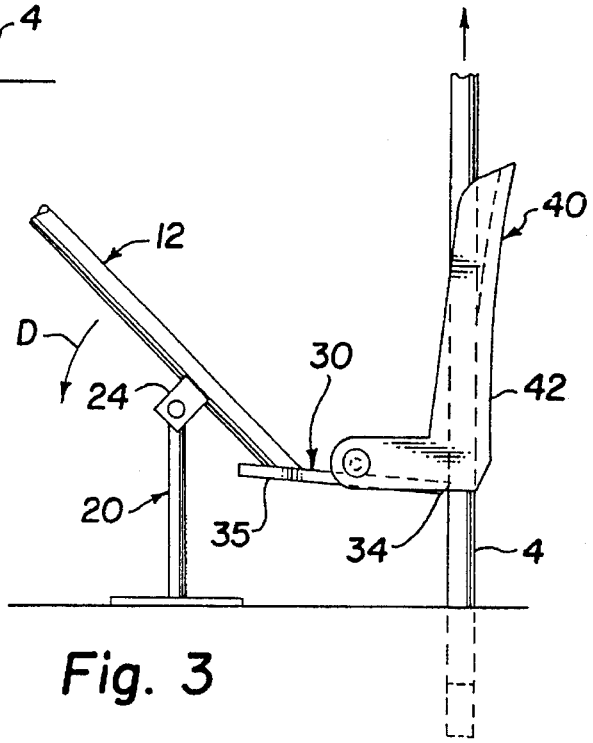
Fig. 3

STAKE PULLER WITH STAKE SUPPORTING BACK PLATE

TECHNICAL FIELD OF THE INVENTION

The present invention relates to a stake puller for use in efficiently dislodging a stake embedded in the ground. Specifically, the stake is pinched between a blade and a back plate while a lever and fulcrum are then used to remove the stake from the ground.

BACKGROUND OF THE INVENTION

Stakes are used in a variety of applications. For example, whenever concrete is poured for a foundation or a sidewalk, a form must be built to contain the liquid concrete and to shape it while it hardens. The form is little more than planks of wood horizontally fixed to the ground with stakes. The stakes are typically pieces of wood with a pointed end and a flat end. The stakes are pounded into the ground with a mallet or hammer. The form are then fixed to the stakes with appropriate fasteners such as nails or ties. After the concrete hardens, the forms are removed which requires pulling the stakes from the ground.

Removing the stake from the ground can be an arduous task. Attempting to remove the stake by hand can lead to severe physical injury to one's back. Moreover, the stake is rough on the hands. Some construction workers attempt to loosen the stake first by kicking it. Of course, this can easily lead to injury to the foot. Other workers might try to loosen the stake with a mallet. However, striking the stake can damage the concrete. A need exists for a mechanical device for removing the stake.

One example of such a device is disclosed in U.S. Pat. No. 2,777,726 to Lundgren et at. entitled "Post Removing Device." The Lundgren device uses a lever and fulcrum for mechanical advantage. A post engaging element is pivotally attached to the distal end of the lever. The post engaging element includes an L-shaped arm and a slidable jaw. The post is captured between the arm and jaw. The lever is then used to pull the stake upward. The post is captured by force exerted by both the arm and the slidable jaw. However, the arm and slidably jaw necessarily apply these forces at different points on opposite sides of the post. Thus, the Lundgren device produces shear and bending forces on the post. This may be of little concern with metal posts, but can be ruinous when applied to old wooden stakes used in construction.

Another example of a stake puller is disclosed in U.S. Pat. No. 4,161,310 to Parker entitled "Metal Fence Post Puller." The Parker device also uses a lever and fulcrum to gain mechanical advantage. A pair of flat bar members are pivotally attached to one end of the lever arm. A connecting member extends between the bar members. A pair of semidisc members are rigidly fixed to the end of the lever arm. The puller is positioned so the post is captured between the bar members, the semidisc plates and the connecting member. When the lever arm is pivoted about the fulcrum, the post is pinched between the semidisc plates and the connecting member. However, as with the Lundgren device described above, the forces applied by the semidisc plates and the connecting member are not directly opposite to each other, resulting in a bending force to the post. Of course, Parker only envisions the use of his post puller with metal fence posts.

A need exists for a stake puller suitable for use with wooden stakes. Such a stake puller must minimize any bending forces applied to the stake. Such a puller must also be effective in removing stakes driven deeply into the ground. Specifically, the puller should be capable of being "pumped," or reapplied to the stake without having to reposition the puller between each effort.

SUMMARY OF THE INVENTION

The stake puller which embodies the present invention is suitable for wood or metal stakes. It utilizes a lever and fulcrum to gain mechanical advantage. A blade is fixed to one, end of the lever, while a back plate is pivotally attached to the blade. The stake to be removed is positioned between the blade and the back plate. When the user pivots the lever downward, the stake is compressed between the blade and the back plate and pulled upward.

If the stake is deeply embedded in the ground, the process may be repeated. In other words, after the initial effort, the blade is disengaged from the post, and the lever raised to a comfortable starting position. Disengagement of the blade from the stake is assisted by the shape of the front edge of blade which tapers inward from top to bottom. This taper allows the user to simply pivot the lever upward. The blade disengages the stake and slides down the surface of the stake. The lever is pivoted downward again, lifting the stake further. In essence, a pumpimg action can be used.

The primary surface of the back plate is curved and diverges from the stake. The curve in the back plate serves an important purpose. If the stake slides up the primary surface during removal, the curve produces a shorter contact surface. This minimizes any friction force between the stake and the back plate. Likewise, if the back plate is prevented from rotating relative to the blade by the stake, then the back plate will tend to rotate into the plane of motion for the stake. A curved back plate minimizes the risk of contact between the upper portion of the back plate and the stake. Bending forces applied by such contact absorbs some of the force which should be used to dislodge the stake from the ground. Moreover, bending the stake can damage or even break the stake.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIG. 1 provides a perspective view of a stake puller embodying the present invention;

FIG. 2 provides a side view of the puller in position around a stake but not yet engaged with the stake; and FIG. 3 provides a side view of the puller engaged with the stake in the stake pulling position.

DETAILED DESCRIPTION OF THE DRAWINGS

The present invention relates to a stake puller which overcomes many of the disadvantages found in the prior art. FIG. 1 illustrates a stake puller 10 which embodies the present invention. The puller 10 has a lever arm 12 pivotally attached to a fulcrum 20. The lever 12 has a proximal end 14, an intermediate portion 16 and a distal end 18. The proximal end 14 acts as a handle for the user. A pair of flanges 24 extend from the intermediate portion 16.

A fulcrum 20 is pivotally attached to the intermediate portion 16 of the lever 12. The fulcrum 20 uses a central pillar 26 attached at one end to a foot 22. The foot increases the stability of the stake puller in use. The other end of the pillar 26 is pivotally attached to lever flanges 24 by pin means 28. The pin allows the lever to rotate as indicated by arrows A. A blade 30 is attached to the distal end of lever 18. The blade is a generally planar member with a front portion having a forward edge 34 and a back portion 35. The blade has a top surface and a bottom surface and it is preferably tapered from the bottom surface toward the top surface to form the forward edge of the blade. A sleeve 32 is transversely mounted on the upper surface of the blade 30. An obtuse angle is formed between the lever 12 and the blade 30. A back plate 40 is pivotally attached to the blade 30. The back plate 40 is formed by a primary surface 42. A pair of side surfaces 44 can be integrally formed with the primary surface. A pair of flange portions 46 extend from the side surfaces 44. A pin 48 cooperates with the sleeve 32 and flange portions 46 to allow rotation of the back plate 40 relative to the blade 30 as shown by arrows B. In another embodiment, the back plate could be rotably mounted to the distal end of the lever.

FIGS. 2 and 3 illustrate the method of using the stake puller 10 to remove a stake 4 from the ground 2. The stake puller 10 is lowered over the stake 4 so that the stake 4 is positioned between the forward edge 34 of the blade 30 and the primary surface 42 of the back plate 40. It is preferable to have the stake immediately adjacent to the primary surface 42. The stake puller 10 can be positioned around a stake of any height. Note that the primary surface 42 is slightly curved so that its upper portion diverges from the stake (which is typically straight). The foot 22 should be in a stable position. In FIG. 2, lever 12 is pivoted about pin 28 in the direction indicated by arrow C. The front edge 34 of blade 30 engages the stake 4 and compresses it against the primary surface 42 of the back plate 40. In FIG. 3 further movement of the lever represented by arrow D drives the front edge 34 into the stake 4 and begins to lift the stake out of the ground in the direction indicated by the unnumbered arrow.

The lever provides the mechanical advantage needed to overcome the ground force applied to the stake. The force applied to the stake by the user is equal to the distance between the fulcrum and the point where the user grasps the lever multiplied by the downward force applied by the user and divided by the distance between the fulcrum and the stake. Thus, one wants to maximize the distance between the fulcrum and the user and minimize the distance between the fulcrum and the stake. The angle between the blade 30 and the lever 12 should allow the blade to avoid engagement with the post while keeping the end 14 of the lever 12 at a comfortable height for the user.

If the stake is deeply embedded in the ground, the process may be repeated. In other words, after the initial effort, the blade is disengaged from the post, and the lever raised to a comfortable starting position. Disengagement of the blade from the stake is assisted by the shape of the front edge 34 of blade 30. The front edge 34 tapers inward from top to bottom. This taper allows the user to simply pivot the lever upward. The blade disengages the stake and slides down the surface of the stake. This reverse pivot may rock the stake puller 10 on the fulcrum 20 slightly. However, the tapered forward edge of blade 30 allows for a "pumping action" to remove a deeply embedded stake.

The stake puller can be manipulated in several ways during stake removal. In a first mode, the fulcrum stays firmly in place and the lever arm sweeps through a circular arc. In the first mode, the curve of the back plate 40 serves an important purpose. After the stake 4 is engaged, the user continues to pivot the lever arm down. The position of the back plate to the blade is essentially fixed by the stake itself. Thus, the back plate tends not to rotate relative to the blade 34. Instead, the back plate and blade are both pivoted relative to the fulcrum, sweeping in a circular arc. The exposed portion of the stake is pushed away from the user by the blade. The stake tilts because a portion is still underground. If the backplate were flat, the tilted stake could contact the upper portion of the backplate, producing bending forces on the stake. Instead, the curve in the backplate minimizes the risk of binding or breakage.

In a second mode, the lever arm is both rotated and pulled by the user, rocking the fulcrum back on its foot. The rocking motion compensates for the circular are of travel taken by the blade. As discussed above, the arcuate path tends to tilt the stake during removal. By pulling the lever back during rotation, the path of the blade, backplate and stake are flattened. With thicker stakes in harder ground, the resistance of the stake to tilting will force the fulcrum to rock. In either case, the upper portion of the primary surface tends to rotate into the plane of the stake. Therefore, if the primary surface were flat, it would engage the stake during the pivoting motion of the lever. By having the upper portion of the plate diverge from the stake, the risk of contact during stake removal is minimized.

The motion of the stake and stake puller during removal can be complex. As described above, the pressure applied to the stake by the blade can fix the position of the back plate relative to the blade. However, the stake can be pulled upward relative to the back plate. In other words, in a third mode, the stake slides along the primary surface. In this instance, the curved primary surface produces a shorter surface in contact with the sliding stake, thus reducing the amount of friction between the stake and back plate. Less energy is wasted overcoming this sliding friction allowing more energy to be used for removing the stake from the ground.

In one embodiment, the lever is formed of 1.25 inch diameter tubing which is 36 inches long. The lever flanges 24 extend 1.5 inch out from the lever. Pillar 20 is 0.75 inch diameter tubing which is 8 inches long. Foot 22 is 0.25×4×4 inches in dimension. Likewise, the blade 30 is 0.25×3×7 inches in dimension, being respectively the thickness, width and length The sleeve 32 is located 2.25 inch from the forward edge 34. The back plate 40 provides a 7 inch long primary surface 42. Flange portions 46 space the primary surface 42 of the back plate 2.75 inches from the sleeve 32. Thus, when the primary surface is substantially perpendicular to the blade 30, a 0.5 inch gap exists between the forward edge 34 from the primary surface 42. The primary surface can be 0.25 inch in thickness and 4 inches in width. Thus the primary surface is generally a rectangular surface 4 inches wide and 7 inches long. Obviously, the stake puller can be dimensioned to handle any size stake. The stake puller is preferably made of steel or other suitable metal. The surface of the stake puller can be painted with a rust inhibiting paint.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. A stake puller for removing a wooden stake from the ground wherein the stake to be pulled has a thickness, width and opposite flat surfaces, comprising:

a lever arm having a proximal end which serves as a handle, an intermediate portion and a distal end opposite the handle;

a fulcrum pivotally attached to the intermediate portion of the lever arm, having a central pillar and a foot which rests on the ground to support the lever arm when pulling a stake;

a generally planar blade having a back portion fixed to the distal end of the lever arm and a front portion having forward edge for engaging a flat side of a stake;

a rigid back plate having a generally rectangular primary surface facing the forward edge of the blade and a pair of generally right angled flange portions spaced apart by the primary surface and each flange portion extending generally perpendicularly away from the primary surface of the back plate toward the lever arm;

means for pivotally attaching the pair of flange portions to the blade at an intermediate location between the back portion and forward edge of the blade at a distance from said forward edge which establishes a gap sufficient for receiving a wooden stake between the primary surface of the back plate and the forward edge of the blade, said back plate and blade being configured to slide over the upper end of a stake to be pulled by pivoting of the back plate toward the lever arm;

said gap being reduced by downward force on the handle until the opposite flat surfaces are engaged at substantially opposed locations whereby nearly directly opposite force is applied to opposite flat surfaces of the stake which are pressed between the blade and the back plate while the stake is raised from the ground.

2. The stake puller of claim 1 wherein as viewed in its stake pulling position, the back plate having a lower part with the right angled flange portions of the rigid back plate extending away from the lower part of the back plate and the primary surface rising upwardly above the flange portions, a substantial portion of the primary surface being configured to contact a flat surface of a stake to be pulled.

3. The stake puller of claim 2 wherein the width of the primary surface is slightly wider than the width of a stake to be pulled.

4. The stake puller of claim 3 wherein the back plate further includes side surfaces along both sides of the primary surface which help receive the stake.

5. The stake puller of claim 3 wherein the blade has a length that is about the same length as the primary surface and the means for pivotally attaching the pair of flanges to the blade is attached to ends of said pair of flanges at an intermediate location on the blade which is about midway between the distal end of the lever and forward edge of the blade.

6. The stake puller of claim 5 wherein the means for pivotally attaching the pair of flange portions of the back plate comprises a sleeve fixed to the blade and a pin which extends through the sleeve.

7. The stake puller of claim 3 wherein the distal end of the lever is attached to the back portion of the blade so that an obtuse angle between the lever and the blade is formed, in order to allow the handle to be raised a comfortable height for the user when the foot of the fulcrum is on the ground.

8. A stake puller for removing a wooden stake from the ground wherein the stake to be pulled has a thickness, width and opposite flat surfaces, comprising:

a lever arm having a proximal end which serves as a handle, an intermediate portion and a distal end opposite the handle;

a fulcrum pivotally attached to the intermediate portion of the lever arm, having a central pillar and a foot which rests on the ground to support the lever arm when pulling a stake;

a generally rectangular blade having a back portion fixed to the distal end of the lever arm and a front portion having a forward edge for engaging a flat surface of a stake in cooperation with a back plate;

a rigid back plate having a generally rectangular primary surface facing the forward edge of the blade and a generally right angled flange portion extending generally perpendicularly from each side of the primary surface, extending away from the primary surface of the back plate toward the blade and lever arm, the primary surface having a width slightly wider than the stake to be pulled, said primary surface being spaced by a gap in front of the forward edge of the blade;

means for pivotally attaching an end of each flange portion of the back plate at an intermediate location between the back portion and the forward edge of the blade at a distance from said forward edge that establishes said gap sufficient for receiving between the primary surface of the back plate and the forward edge of the blade a stake to be pulled when the back plate is pivoted toward the lever arm to allow the back plate and blade to slide down over the upper end of a stake to be pulled;

the back plate being configured to extend away from said flange portions above said gap when the back plate and blade are slid down over the upper end of a stake to be pulled so that the primary surface can support one side of said stake substantially directly opposite the blade;

said gap being sized to be reduced to less than the thickness of a stake to be pulled by downward movement on the handle whereby the blade presses into the stake to be pulled while the back plate supports said stake substantially directly opposite the blade while said stake is raised from the ground.

9. The stake puller of claim 8 wherein the distal end of the lever is attached to the back portion of the blade in such a manner that an obtuse angle between the lever and the blade is formed, in order to allow the handle to be raised to a comfortable height for the user when the foot of the fulcrum is on the ground.

10. The stake puller of claim 9 wherein the back plate further includes side surfaces along both sides of the primary surface which help receive the stake.

11. The stake puller of claim 10 wherein the width of the primary surface is slightly wider than the width of a stake to be pulled and the width of the forward edge of the blade is about 75 percent of the width of the primary surface of the back plate.

12. The stake puller of claim 11 wherein as viewed in its stake pulling position, the primary surface of the back plate rises upwardly above the flange portions, a substantial portion of the primary surface being configured to contact a flat surface of a stake to be pulled.

13. The stake puller of claim 12 wherein the blade is nearly perpendicular to the primary surface of the back plate when a stake to be pulled is pressed between the forward portion of the blade and the primary surface while said stake is being pulled.

14. The stake puller of claim 8 wherein the blade is nearly perpendicular to the primary surface of the back plate when a stake is pressed between the forward portion of the blade and the primary surface while said stake is being pulled.

15. A stake puller for removing a wooden stake from the ground, comprising:

a lever arm having a proximal end which serves as a handle, an intermediate portion and a distal end opposite the handle which is closest to a stake to be removed;

a fulcrum pivotally attached to the intermediate portion of the lever arm, said fulcrum having a central pillar and a foot which rests on the ground to support the lever arm when pulling a stake;

a generally planar blade fixed to the distal end of the lever arm at an angle that allows the handle to be raised a comfortable height for the user when the foot of the fulcrum is on the ground and the blade is nearly horizontal, the blade having a forward edge for contacting one side of a stake;

a rigid back plate having a primary surface and a pair of flange portions separated by the primary surface and extending generally perpendicularly away from it in the direction of the blade, the primary surface and said flanges being sized to receive the width of a stake between the flange portions with a flat surface of the stake parallel to the primary surface;

the flange portions of the back plate extending away from the primary surface of the back plate being pivotally connected to the blade between the forward edge of the blade and the place where the blade is fixed to the distal end of the lever arm, at a distance which leaves a gap between the front edge of the blade and the primary surface of the back plate slightly less than the thickness of a stake to be pulled;

wherein a stake extending from the ground and located in the gap between the front edge of the blade and the primary surface of the back plate is engaged and pressed against the primary surface by the blade and held at substantially opposed locations when the handle is moved downward whereby pressing force is applied to nearly directly opposite locations on a stake to be pulled sufficient to hold said stake while it is pulled upward from the ground.

16. The stake puller of claim 15 wherein the central pillar of the fulcrum and the angle of the blade with respect to the lever arm are sized and configured so that the blade is nearly horizontal and the back plate is nearly vertical when the stake puller is placed down over the end of a stake to be pulled and the stake is pressed between the forward edge of the blade and the primary surface in preparation for pulling the stake.

17. The stake puller of claim 15 wherein the length of the blade extending from the means for pivotally attaching to the forward edge is about 2¼ inches.

18. The stake puller of claim 15 wherein the back plate has a primary surface having an upper part which is curved.

* * * * *